US008057008B2

(12) United States Patent
McCracken et al.

(10) Patent No.: US 8,057,008 B2
(45) Date of Patent: Nov. 15, 2011

(54) INK CONDUCTIVITY FAULT TOLERANT MODE

(75) Inventors: Ivan Andrew McCracken, Portland, OR (US); David L. Knierim, Wilsonville, OR (US); Michael Kenneth Oehl, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 681 days.

(21) Appl. No.: 12/242,992

(22) Filed: Oct. 1, 2008

(65) Prior Publication Data

US 2010/0079512 A1 Apr. 1, 2010

(51) Int. Cl.
*B41J 29/393* (2006.01)
*B41J 2/175* (2006.01)

(52) U.S. Cl. ..... 347/19; 347/7; 347/85

(58) Field of Classification Search ..... 347/5, 7, 347/19, 85, 88

See application file for complete search history.

(56) References Cited

U.S. PATENT DOCUMENTS

| | | | | |
|---|---|---|---|---|
| 6,155,664 | A * | 12/2000 | Cook | 347/7 |
| 6,494,553 | B1 | 12/2002 | Donahue et al. | |
| 6,575,096 | B1 | 6/2003 | Caruthers et al. | |
| 6,874,861 | B2 * | 4/2005 | Farr et al. | 347/19 |
| 6,929,343 | B2 * | 8/2005 | Farr et al. | 347/19 |
| 7,556,326 | B2 * | 7/2009 | Knierim et al. | 347/7 |
| 2007/0076023 | A1 | 4/2007 | Knierim et al. | |

* cited by examiner

*Primary Examiner* — Anh T. N. Vo

(74) *Attorney, Agent, or Firm* — Maginot, Moore & Beck LLP

(57) ABSTRACT

A method of operating an imaging device comprises measuring an ink conductivity of an ink volume in an ink reservoir of an imaging device. The imaging device is operated in a conductivity fault tolerant mode in response to the measured ink conductivity being outside of a predetermined ink conductivity operational range. In the conductive fault tolerant mode, at least one parameter of a melt duty cycle for the ink reservoir is set to a corresponding conductivity fault tolerant (CFT) level.

19 Claims, 17 Drawing Sheets

INK CONDUCTIVITY FAULT TOLERANT MODE

TECHNICAL FIELD

This disclosure relates generally to ink jet printers, and in particular, to methods of maintaining ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a melt reservoir. The melt reservoir is configured to maintain a quantity of melted ink in liquid or melted form and to communicate the melted ink to one or more printheads as needed.

In order to prevent the ink storage and supply assembly 400 of the imaging device from exhausting the available supply of ink, the reservoirs 404 of the ink storage and supply assembly 400 may be provided with ink level sensors. Recently, ink level sensors have been developed that enable a continuous measurement of the level of ink in the reservoirs of the printer. These ink level sensors include a lower probe positioned near a lower portion of the reservoir, an upper probe that extends upward form the lower probe toward the top of the reservoir, and an outer probe. To detect the level of ink in an ink reservoir, an AC signal is driven to the outer probe. The ink in the reservoir conducts the AC signal to the lower probe and to the upper probe. A current flow is detected from the outer probe through the ink to the lower probe and from the outer probe through the ink to the upper probe. Assuming that the ink temperature and conductivity remains relatively consistent, a substantially constant current flow is detected via the lower probe. Varying levels of current flow are detected via the upper probe as more or less of the upper probe's surface area is covered or uncovered in ink. A continuous measurement of the height of ink in the ink reservoir may then be determined by comparing the varying current flow in the upper probe to the constant current flow in the lower probe.

The ink level sensor described above is robust to variation in ink conductivity that may result due to normal variation in the manufacturing processes of the ink and/or due to natural variation in the ink components. For example, due to variation inherent in the manufacture of ink from raw components, a moderate variation in the conductivity of the ink may be expected from batch to batch and accounted for accordingly. However, if ink having a conductivity that exceeds the range of reliable operation of a level sensor enters the reservoir, the level readings generated by the level sensor for that reservoir may not be accurate or the level sensor may fail altogether resulting in various printhead failures, including introduction of air which causes jetting failure, and weeping of jets which can contaminate the drum.

SUMMARY

In response to the difficulties posed due to contaminated ink, an conductivity fault tolerant (CFT) operational mode has been developed that enables printing operations to be continued while ink conductivity for an ink volume in an ink reservoir is outside of a normal operating range. In one embodiment, the method comprises measuring an ink conductivity of an ink volume in an ink reservoir of an imaging device. The imaging device is operated in a conductive fault tolerant mode in response to the measured ink conductivity being outside of a predetermined ink conductivity operational range. In the conductive fault tolerant mode, at least one parameter of a melt duty cycle for the ink reservoir is set to a corresponding conductive fault tolerant (CFT) level.

In another embodiment, a system for use with an imaging device comprises an ink conductivity sensor positioned in an ink reservoir of an imaging device. The ink conductivity sensor is configured to generate a signal indicative of an ink conductivity of a volume of ink in the ink reservoir. A controller is configured to receive the signal from the ink conductivity sensor and to compare the ink conductivity indicated by the signal to a predetermined ink conductivity operational range. The controller is configured to enter a conductivity fault tolerant mode in response to the ink conductivity being outside of the predetermined ink conductivity operational range in which at least one parameter of a melt duty cycle for the ink reservoir is set to a corresponding conductive fault tolerant (CFT) level.

DETAILED DESCRIPTION OF THE PREFERRED EMBODIMENT

Figure 1:
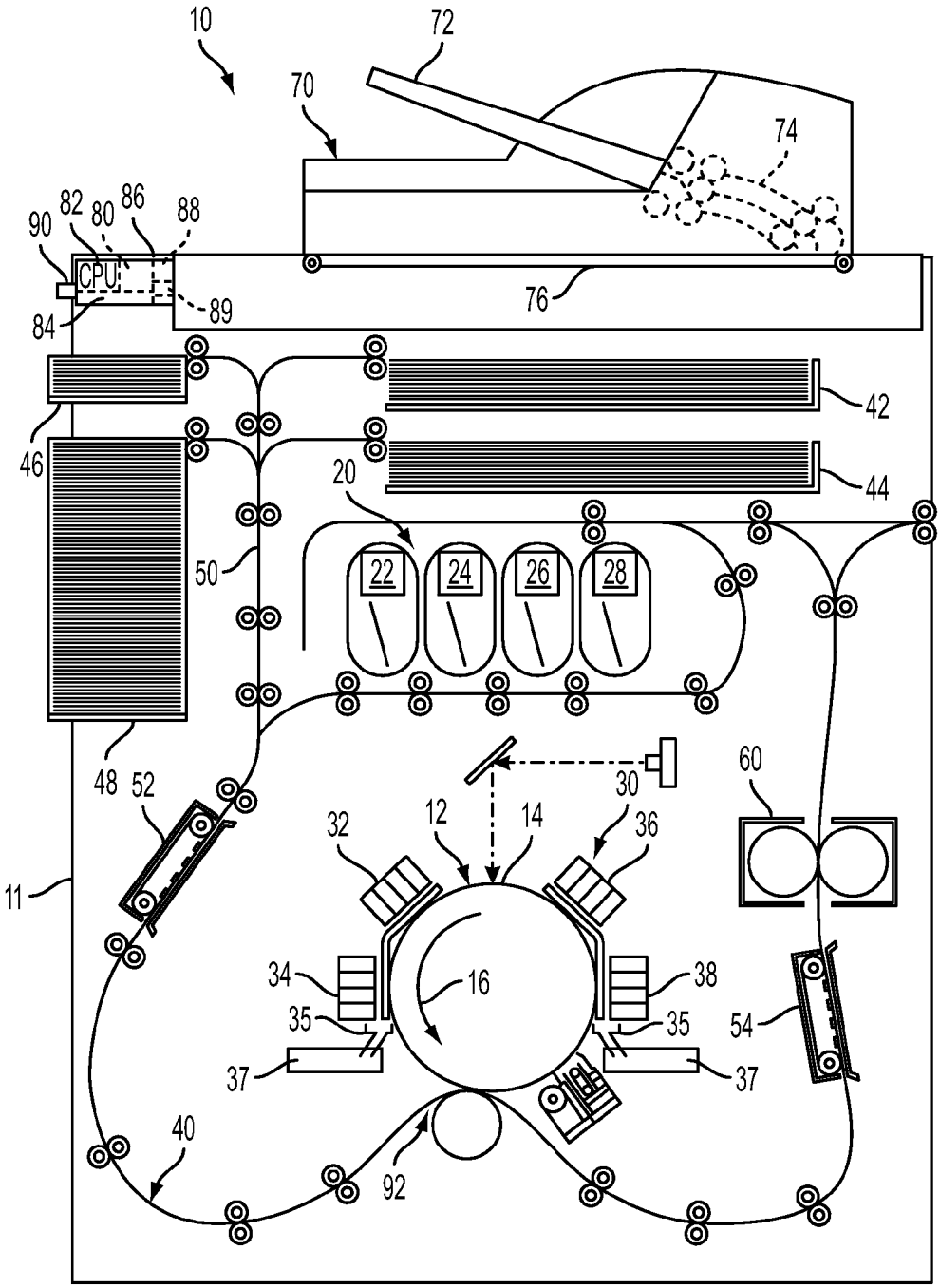
FIG. 1 is block diagram of a phase change ink image producing machine.

For a general understanding of the system disclosed herein as well as the details for the system and method, reference is made to the drawings. In the drawings, like reference numerals have been used throughout to designate like elements. As used herein, the word "printer," "imaging device," "image producing machine," etc. encompasses any apparatus that performs a print outputting function for any purpose, such as a digital copier, bookmaking machine, facsimile machine, a multi-function machine, etc.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes for example four (4) sources 22, 24, 26, 28, representing four (4) different colors CYMK (cyan, yellow, magenta, black) of phase change inks. The phase change ink system 20 also includes a phase change ink melting and control assembly 100 (FIG. 2), for melting or phase changing the solid form of the phase change ink into a liquid form. Thereafter, the phase change ink melting and control assembly 100 then controls and supplies the molten liquid form of the ink towards a printhead system 30 including at least one printhead assembly 32. Since the phase change ink image producing machine or printer 10 is a high-speed, or high throughput, multicolor image producing machine, the printhead system includes for example four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

The printer 10 may include a maintenance system for periodically performing a maintenance procedure on the printhead assembly. Maintenance procedures typically include purging ink through the print head, and wiping the faces of the printheads to remove ink and debris. The purging of ink through the printheads of the printhead assembly may be accomplished in any suitable manner as known in the art. The wiping of the printheads may be performed using at least one wiper blade (not shown) as is known in the art that is moved relative to the nozzle plates of the printheads to remove ink residue, as well as any paper, dust or other debris that has collected on the nozzle plate. As seen in FIG. 1, the maintenance assembly may include gutter assemblies 35 for collecting and guiding purged or wiped ink into one or more waste ink trays 37.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Figure 2:
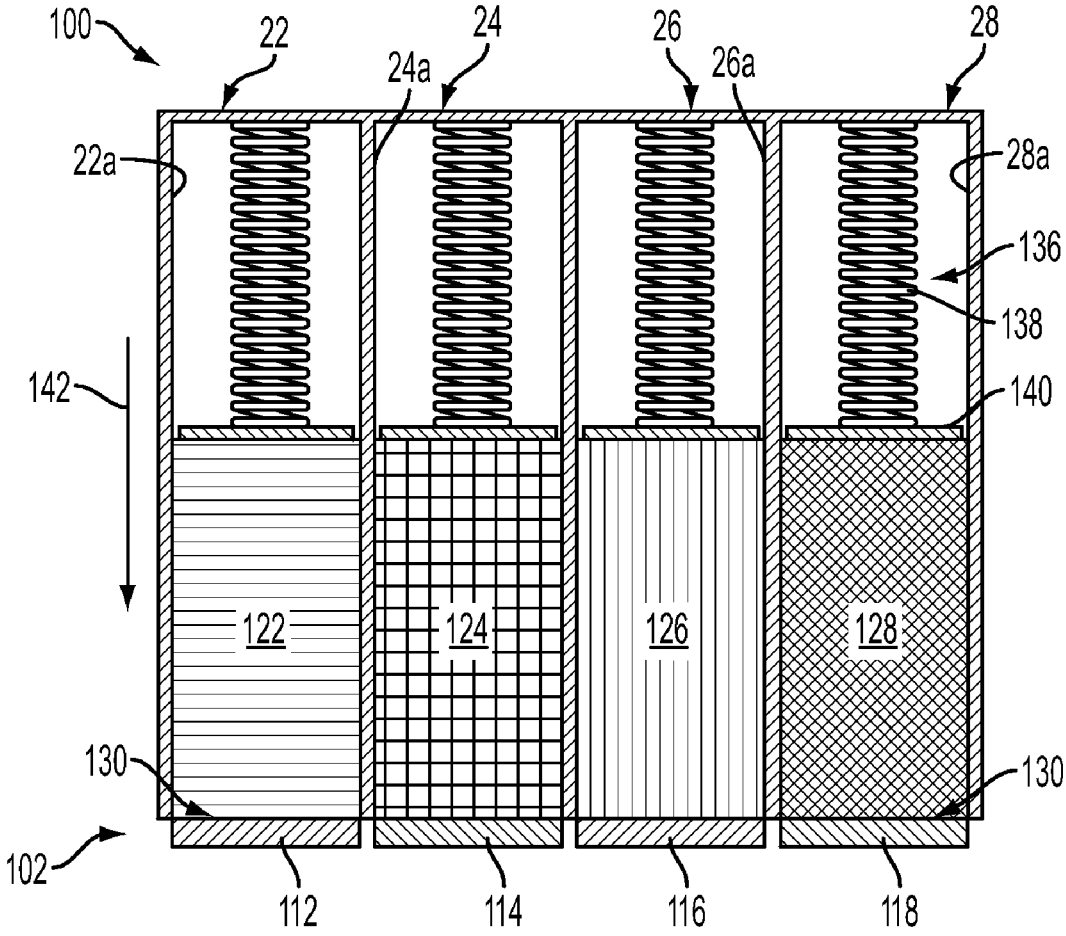
FIG. 2 is top view of four ink sources and a melter assembly having four melter plates of the phase change ink image producing machine of FIG. 1.
Figure 3:
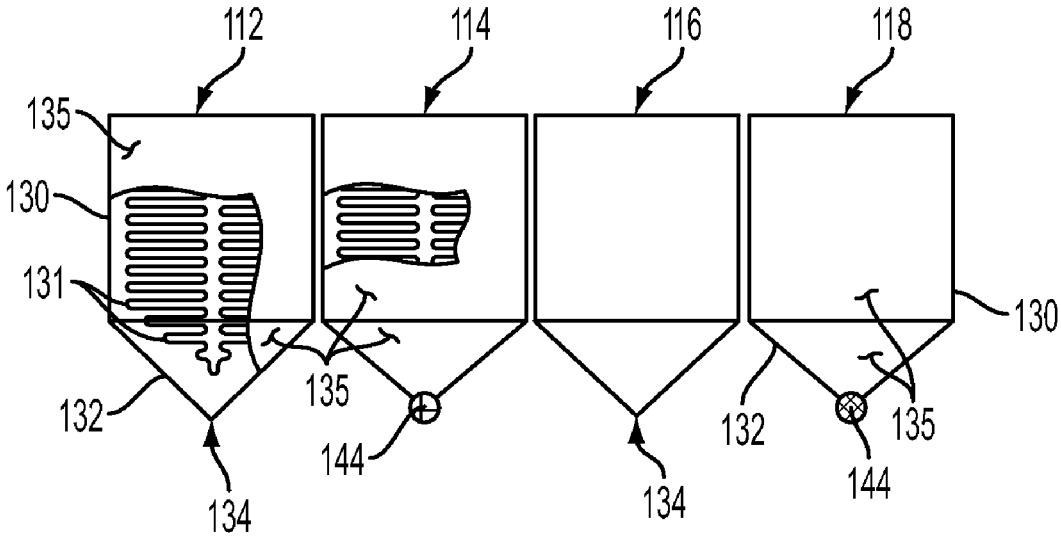
FIG. 3 is front side view of the four melter plates of the melter assembly.

Referring now to FIGS. 2 and 3, there is shown the ink delivery system 100. The ink delivery system 100 of the present example includes four ink sources 22, 24, 26, 28, each holding a different phase change ink in solid form, such as for example inks of different colors. However, the ink delivery system 100 may include any suitable number of ink sources, each capable of holding a different phase change ink in solid form. The different solid inks are referred to herein by their colors as CYMK, including cyan 122, yellow 124, magenta 126, and black 128. Each ink source can include a housing (not shown) for storing each solid ink separately from the others. The solid inks are typically in block form, though the solid phase change ink may be in other formats, including but not limited to, pellets and granules, among others.

The ink delivery system 100 includes a melter assembly, shown generally at 102. The melter assembly 102 includes a melter, such as a melter plate, connected to the ink source for melting the solid phase change ink into the liquid phase. In the example provided herein, the melter assembly 102 includes four melter plates, 112, 114, 116, 118 each corresponding to a separate ink source 22, 24, 26 and 28 respectively, and connected thereto. As shown in FIG. 3, each melter plate 112, 114, 116, 118 includes an ink contact portion 130 and a drip point portion 132 extending below the ink contact portion and terminating in a drip point 134 at the lowest end. The drip point portion 132 can be a narrowing portion terminating in the drip point.

The melter plates 112, 114, 116, 118 can be formed of a thermally conductive material, such as metal, among others, that is heated in a known manner. In one embodiment, solid phase change ink is heated to about 100° C. to 140° C. to melt the phase change ink to liquid form for supplying to the liquid ink storage and supply assembly 400. As each color ink melts, the ink adheres to its corresponding melter plate 112, 114, 116 118, and gravity moves the liquid ink down to the drip point 134 which is disposed lower than the contact portion. The liquid phase change ink then drips from the drip point 134 in drops shown at 144. The melted ink from the melters may be directed gravitationally or by other means to the ink storage and supply assembly 400.

Figure 4:
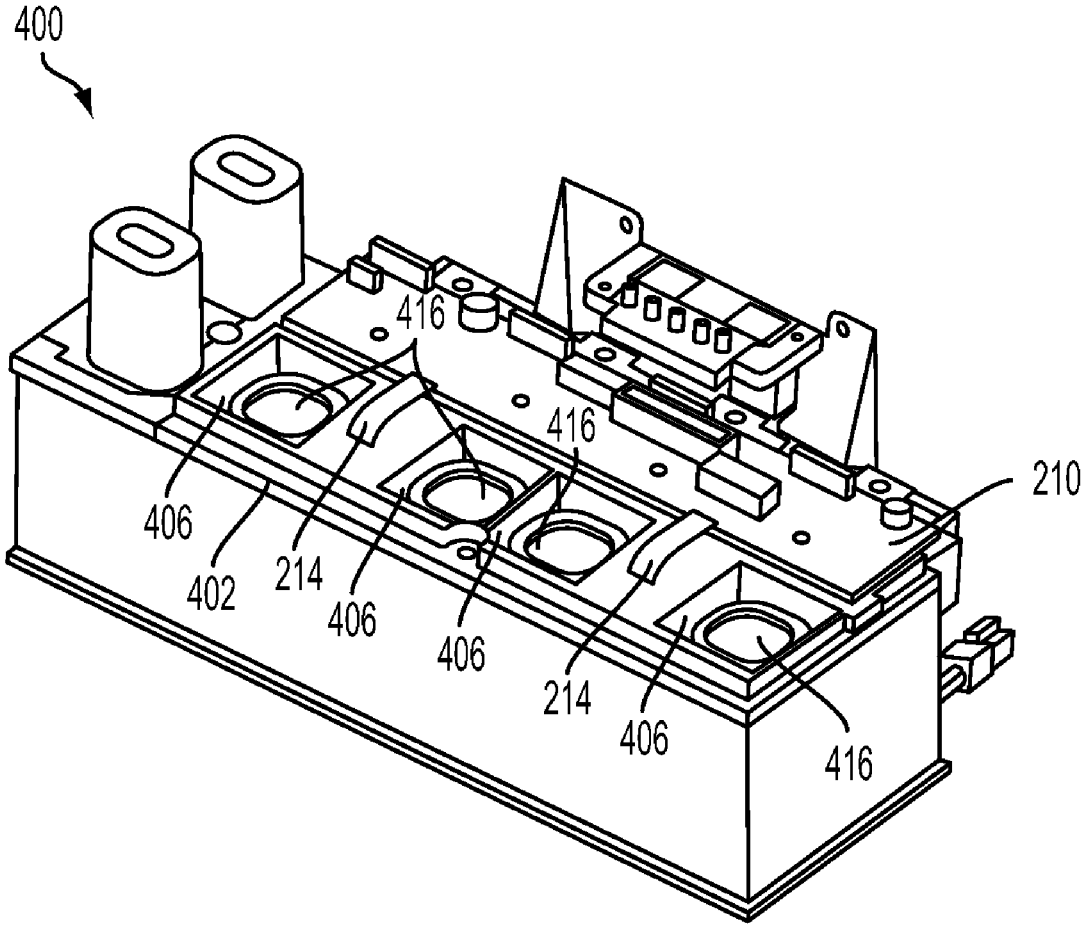
FIG. 4 is a perspective view of an ink storage and supply assembly.
Figure 5:
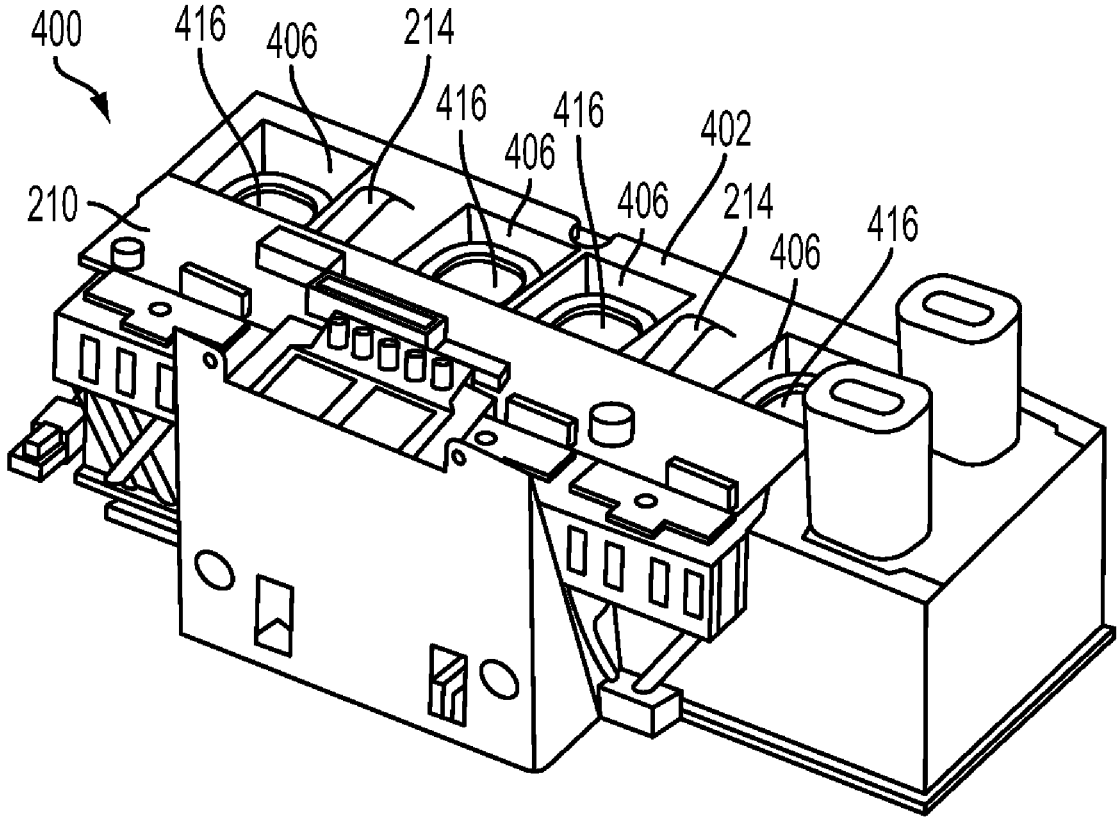
FIG. 5 is another perspective view of the ink storage and supply assembly of FIG. 4.

FIGS. 4 and 5 show front and back perspective views of an embodiment of an ink storage and supply system 400. In the embodiment of FIGS. 4 and 5, the ink storage and supply system 400 includes an ink collector 402 positioned above the primary reservoirs (not shown in FIGS. 4 and 5) of the ink storage and supply system 400. The ink collector 402 includes an opening 406 positioned above each reservoir of the ink storage and supply system 400 that is configured to collect the molten ink as it drips from an ink melter and to direct or funnel the ink into a corresponding reservoir. In some embodiments, the ink collector may also include filters 416 positioned in each opening 406 of the collector that are configured to filter or remove gross contaminants from the ink before the ink enters the reservoirs.

Figure 6:
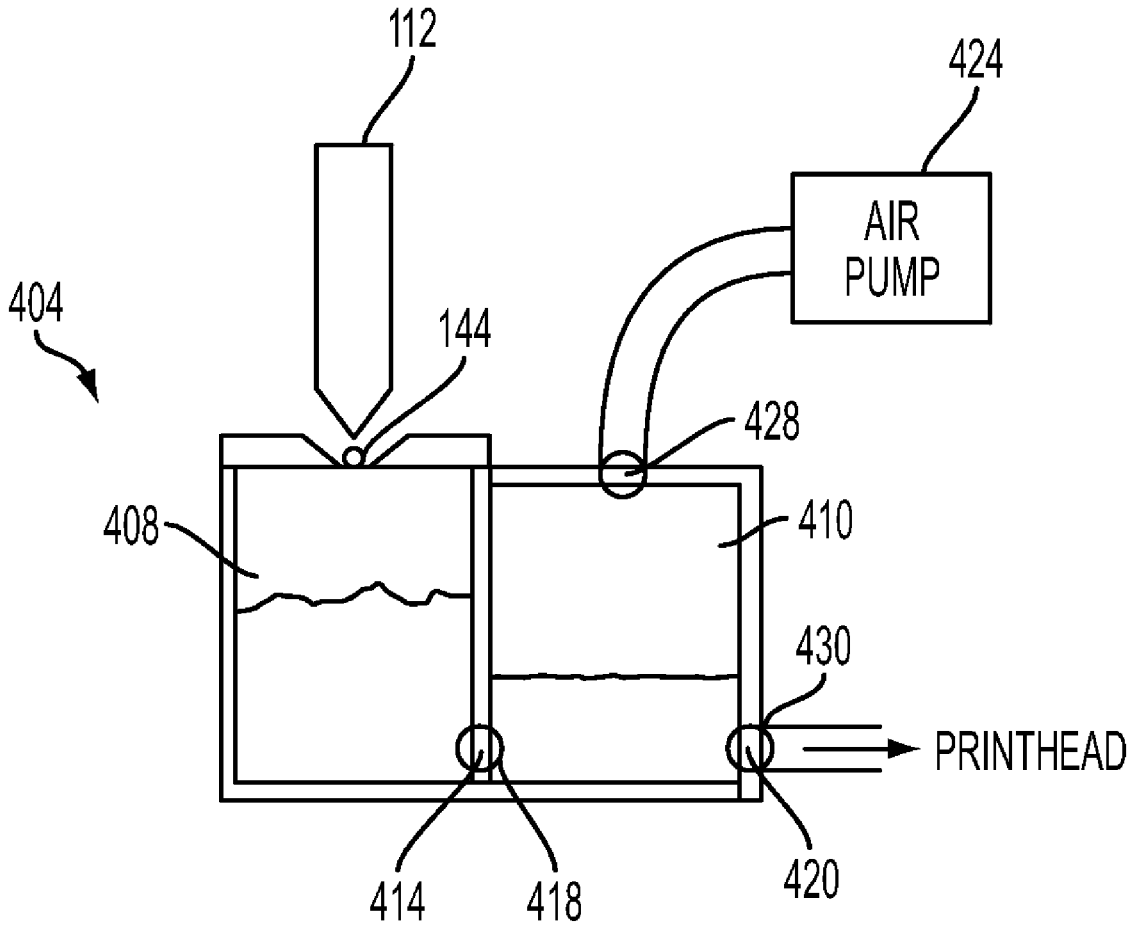
FIG. 6 is a side cross-sectional view of a dual reservoir of the ink melting and control assembly.

In one embodiment, the ink storage and supply system 400 may incorporate a dual reservoir system. FIG. 6 shows a simplified side cross-sectional view of the ink storage and supply system showing an exemplary embodiment of a dual reservoir. In this embodiment, each reservoir 404 of the ink storage and control assembly 400 includes a primary reservoir 408 and a secondary reservoir 410 for each ink source and corresponding ink melter of the ink delivery system. Only one dual reservoir is shown in FIG. 6, but each reservoir 404 of the ink storage and control assembly 400 may be configured as a dual reservoir as depicted in FIG. 6. In the embodiment of FIG. 6, each primary reservoir 408 comprises a low pressure reservoir (LPR) configured to receive molten ink from a corresponding ink melt plate (for example, melt plate 112) of the ink delivery system. Each LPR 408 includes an opening 414 at or near a bottom portion of the LPR 408 through which ink may flow to a corresponding secondary reservoir 410. Gravity, or liquid ink height, may serve as the driving force for causing the molten ink to exit a respective LPR 408 through the opening and into the corresponding secondary reservoir 410. To prevent backflow of ink from a secondary reservoir 410 to the corresponding primary reservoir (LPR) 408, the openings 414 in the LPR's may be provided with one-way check valves 418 that permit ink to flow gravitationally from the LPR 408 into the secondary reservoir 410.

The secondary reservoirs 410 comprise high pressure reservoirs (HPR). Each HPR 410 includes at least one discharge outlet 420 through which molten ink may flow to an ink routing assembly (not shown) for directing ink to one or more printheads (not shown) of the printhead assembly. Each HPR may include a plurality of discharge outlets 420 for supplying ink to a plurality of printheads. For example, in a system that includes four printheads for each color of ink, each HPR may include four discharge outlets, each outlet being configured to supply ink to a different printhead. When charging a printhead with ink, pressure is applied to the ink in a corresponding HPR using, for example, an air pump 424 through a dosing valve 428 or other suitable pressurization means to causing the ink to discharge through the one or more discharge outlets 420 of the HPR. The discharge outlet(s) of the HPR may include check valve(s) 430 or other suitable backflow prevention means that are configured to open to permit the flow of molten ink from the secondary reservoir to the printhead when the HPR is pressurized while preventing backflow of the ink through the opening 420 back into the HPR 410. In addition, the valve 418 in the opening 414 is configured to prevent backflow of ink from the secondary reservoir to the primary reservoir when the secondary reservoir is pressurized.

Figure 7:
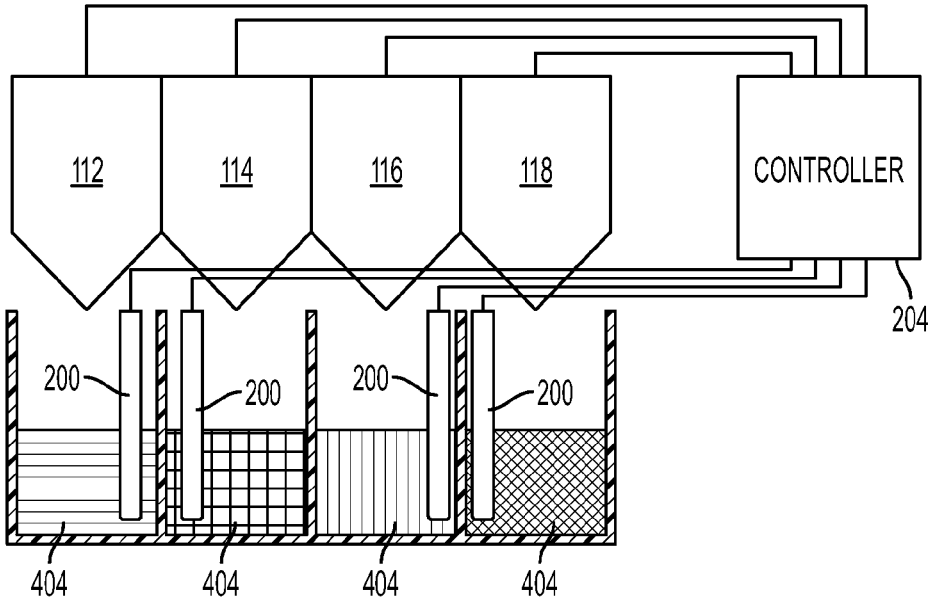
FIG. 7 is a front cross-sectional view of an ink level sensing system.

In order to prevent the ink storage and supply assembly 400 of the imaging device from exhausting the available supply of ink, the reservoirs 404 of the ink storage and supply assembly 400 may be provided with ink level sensors 200. FIG. 7 shows a schematic diagram an exemplary reservoir ink level sensing system for use with the ink storage and supply system 400. As depicted in FIG. 7, the ink level sensing system includes an ink level sensor 200 positioned in each reservoir 404 of the ink storage and supply system 400 and an ink level controller 204. The level sensors 200 are configured to generate one or more signals indicative of the ink level in the corresponding ink reservoir. The ink level controller 204 is configured to receive the signals indicative of the ink levels in each of the reservoirs.

During operation, the ink level controller 204is configured to maintain a substantially consistent amount of melted ink in the reservoirs available for delivery to the printheads. Accordingly, during operations, the controller 204 is configured to monitor the ink level sensors 200 to determine when the ink level of a reservoir reaches one or more predetermined threshold levels. For example, when a level sensor 200 indicates that the ink level in a reservoir has fallen below a "start fill" level, the controller is configured to signal the corresponding ink melter 112, 114, 116, 118 to begin melting and supplying ink to the ink reservoir. The controller 204 is configured to monitor the ink level sensor in the reservoir as the melted ink is being supplied to the reservoir to determine when a "stop fill" level is reached at which point the controller is configured to signal the appropriate melter to stop supplying ink to the reservoir. Detecting an ink supply deficiency, melting the solid ink in response to the deficiency, and refilling the reservoir to a supply level with the melted ink may be referred to as an "ink melt duty cycle." In addition to the start fill and stop fill levels, the controller is configured to monitor the ink levels as the reservoir is being filled to determine when a "last dose" level is reached at which point the controller may pause operations until the reservoir has been replenished. The last dose level corresponds to the level of ink at which continued printing operations run the risk of running the reservoir dry.

The ink level sensors 200 of the present embodiment are configured to measure the level of ink in each of the reservoirs 404 in a substantially continuous manner. As explained in more detail below, the ink level sensors of the present disclosure are configured to sense or detect the height of ink in a reservoir by detecting or measuring a base line conductivity of the ink present in the reservoir with a lower probe 248, shown in FIGS. 12-15, positioned in a lower portion of a reservoir. An upper probe 246, also shown in FIGS. 12-15, extends upward from the lower probe 248 in the reservoir and is configured to detect or measure the conductivity of the ink in the reservoir as the ink height changes and the upper probe 246 becomes covered or uncovered by ink. The ink level in a reservoir is determined by comparing the base line conductance of the ink in a reservoir indicated by the lower probe 246 to the varying conductance of the ink in the reservoir indicated by the upper probe 248.

Figure 8:
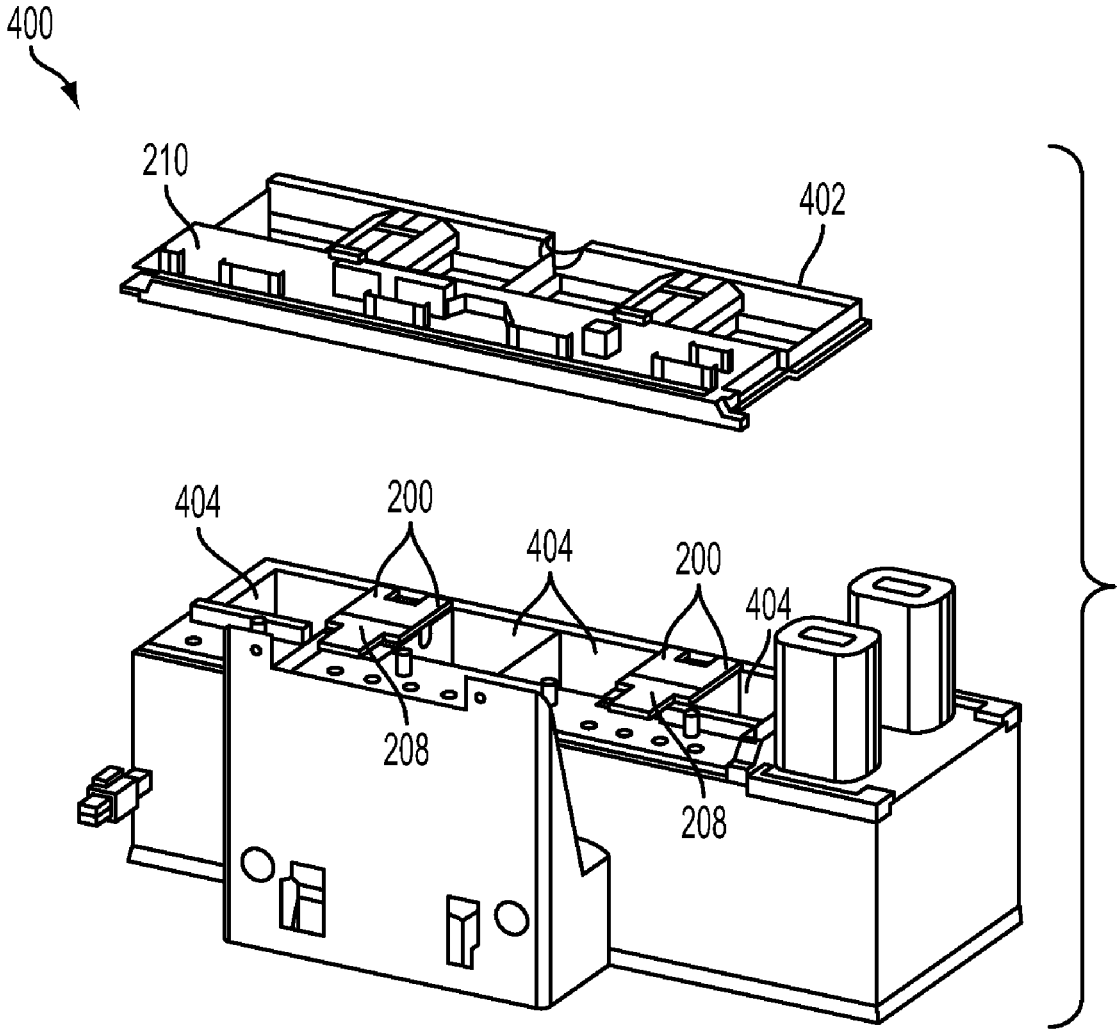
FIG. 8 is a perspective view of the ink storage and supply assembly with the cover removed showing the ink level sensors in the reservoirs.
Figure 9:
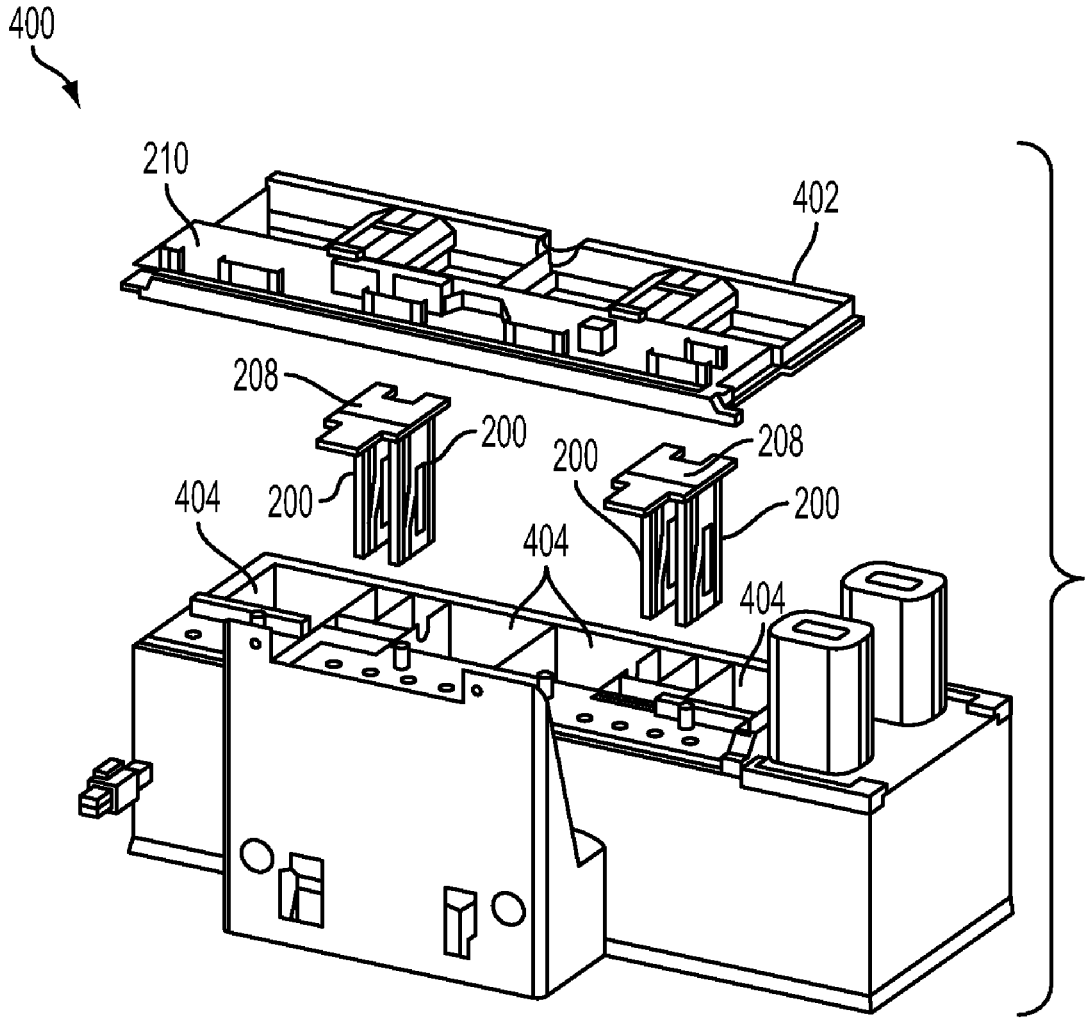
FIG. 9 is a perspective view of the ink storage and supply assembly with the cover removed showing the ink level sensors out of the reservoirs.
Figure 10:
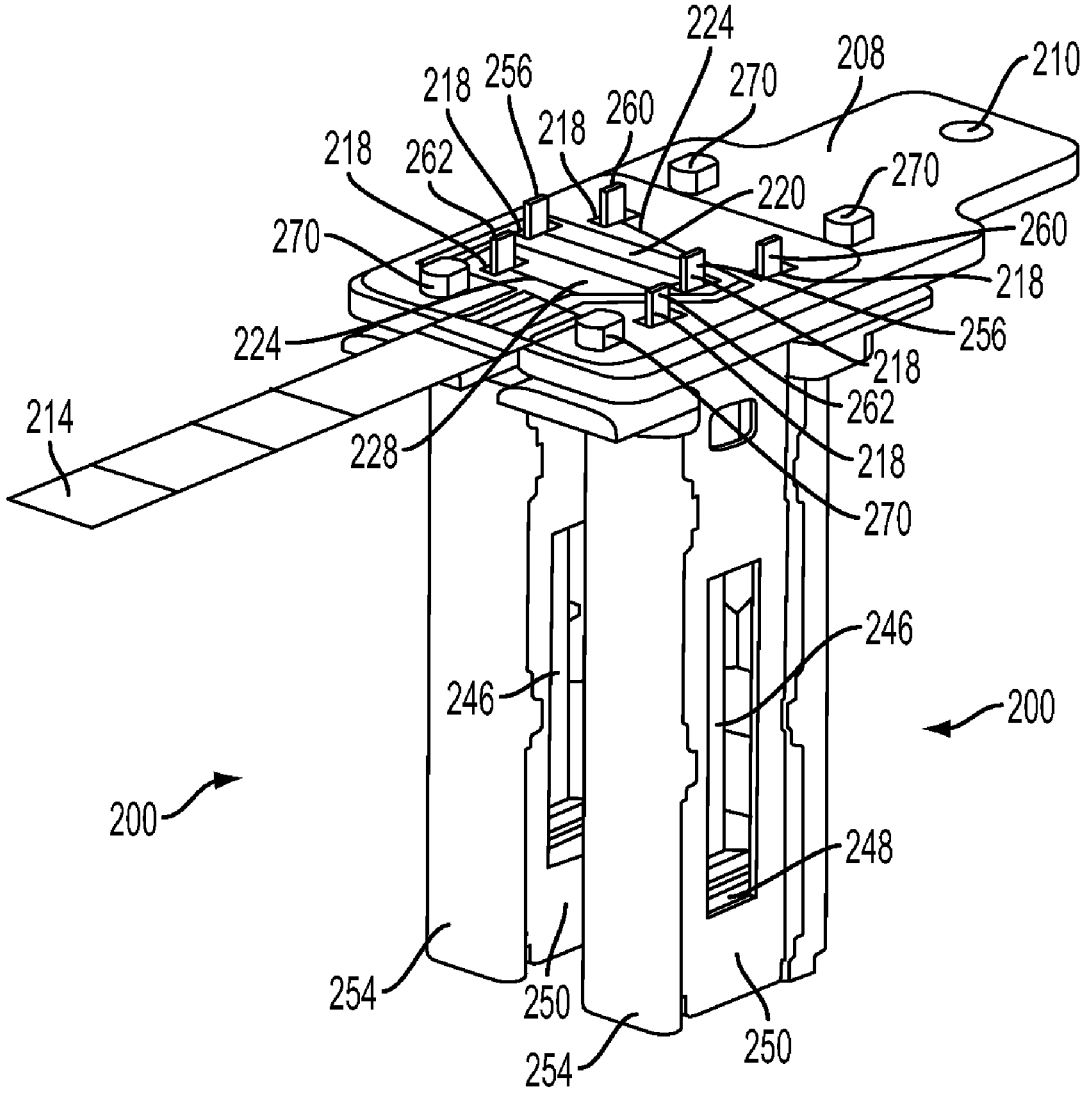
FIG. 10 is a perspective view of a pair of level sensors and the corresponding sensor support and flex tape.
Figure 11:
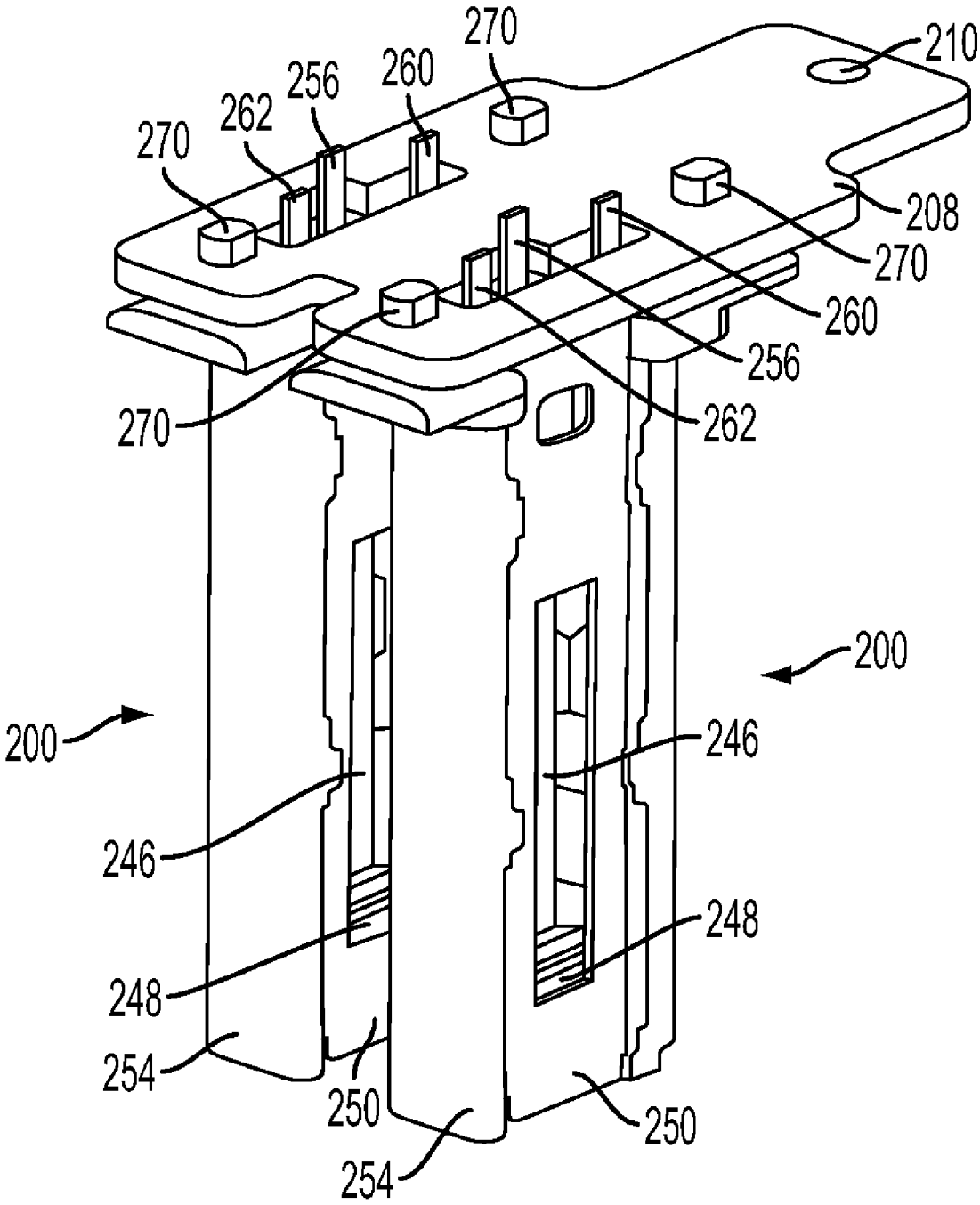
FIG. 11 is a perspective view of the pair of level sensors of FIG. 10 without the flex tape.

FIGS. 8 and 9 show the ink storage and supply system 400 with the ink collector removed showing the reservoirs 404 and corresponding ink level sensors 200 of the present disclosure. In particular, FIG. 8 shows the ink level sensors 200 positioned in each of the reservoirs 404 of the ink storage and supply system 400, and FIG. 9 shows the ink level sensors 200 removed from the corresponding reservoirs 404 for clarity. In the dual reservoir system of FIG. 6, ink level sensors 200 may be provided in the primary reservoirs 408 of the ink storage and supply system 400.

Level sensor positioning support members 208 are operably connected to the level sensors 200 and the ink storage and supply system 400 to locate or position the level sensors in their respective reservoirs 404. As depicted in FIGS. 8-11, a single support member 208 may be used to support two level sensors 200 in adjacent reservoirs (for a total of two support members in the exemplary embodiment). A separate support member, however, may be provided for each level sensor. The support members 208 may be formed of any suitable material capable of supporting the level sensors, such as plastic, and may include features that enable the support members to be secured, fixedly or removably, to ink storage and supply system. For example, the support members may include fastener openings 210 that are configured to receive a fastener, such as a screw or bolt, therethrough and into a corresponding fastener opening (not shown) in the ink storage and supply system. The support members also include appropriate features (explained below) that enable the level sensors to be secured, fixedly or removably, to the support members.

Referring now to FIGS. 12-15, there is shown an embodiment of a level sensor 200. The level sensor 200 includes a body that is configured for insertion into an ink reservoir so that a bottom or lower portion of the sensor is at or near a bottom of the reservoir with the top portion of the sensor at or above the top of the reservoir. The level sensor of FIGS. 12-15 includes a lower probe 248, an upper probe 246, and an outer probe 250 that are supported by an insulating probe support frame 254. The insulating probe support 254 is configured to fixedly position the lower probe 248, upper probe 246, and outer probe 250 relative to each other to ensure that the lower probe, upper probe, and outer probe are physically and electrically isolated from each other. As used herein, a 'probe' shall be defined as any passive or active circuit element or combination of elements that emits or causes there to be emitted a recognizable signal when the probe is in contact with, or otherwise detects the presence of, a liquid. Such probes may rely on optical effects, changes in conductivity, changes in temperature, or any other physical manifestation of the presence of a liquid.

Figure 12:
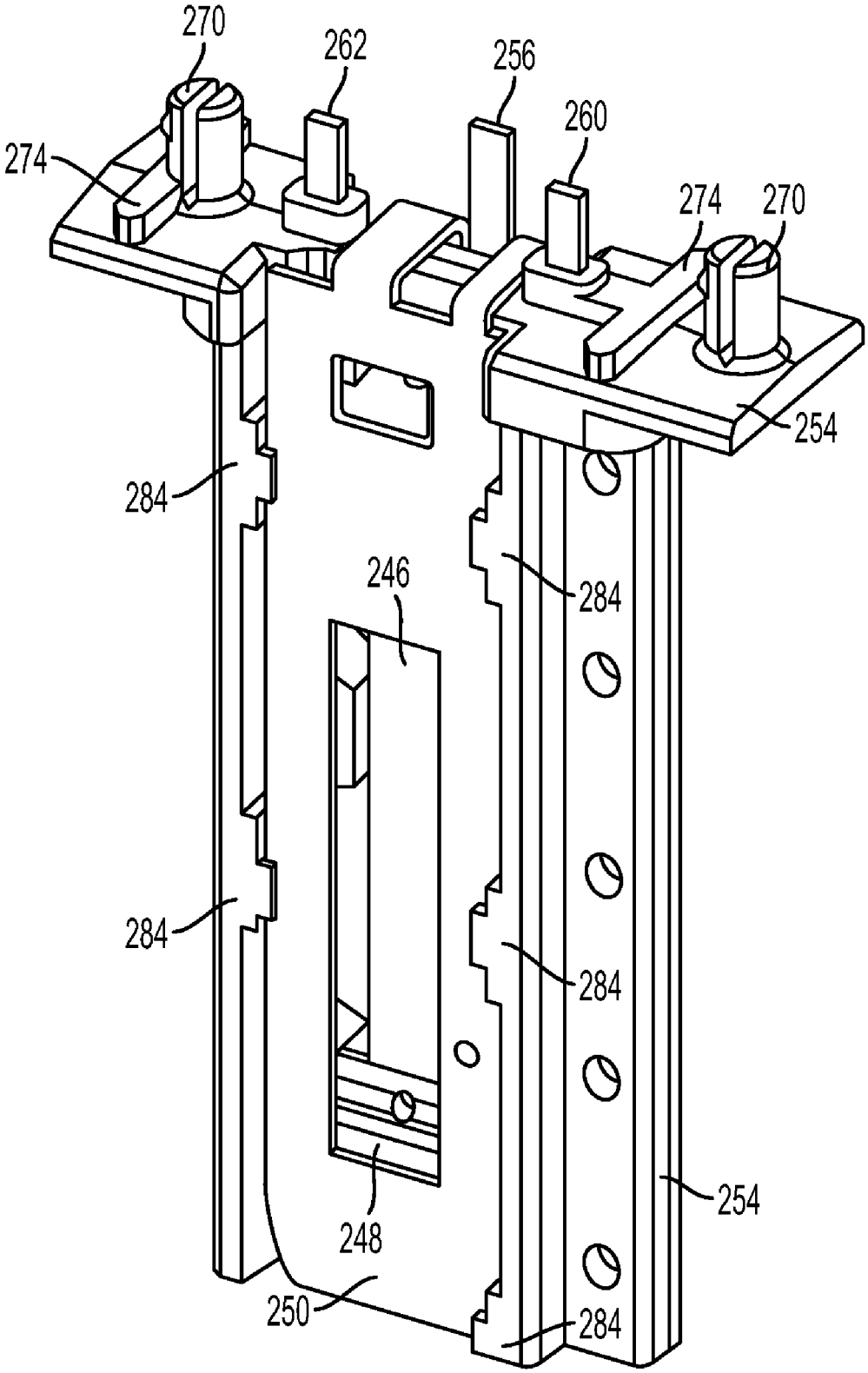
FIG. 12 is a perspective view of a level sensor.
Figure 13:
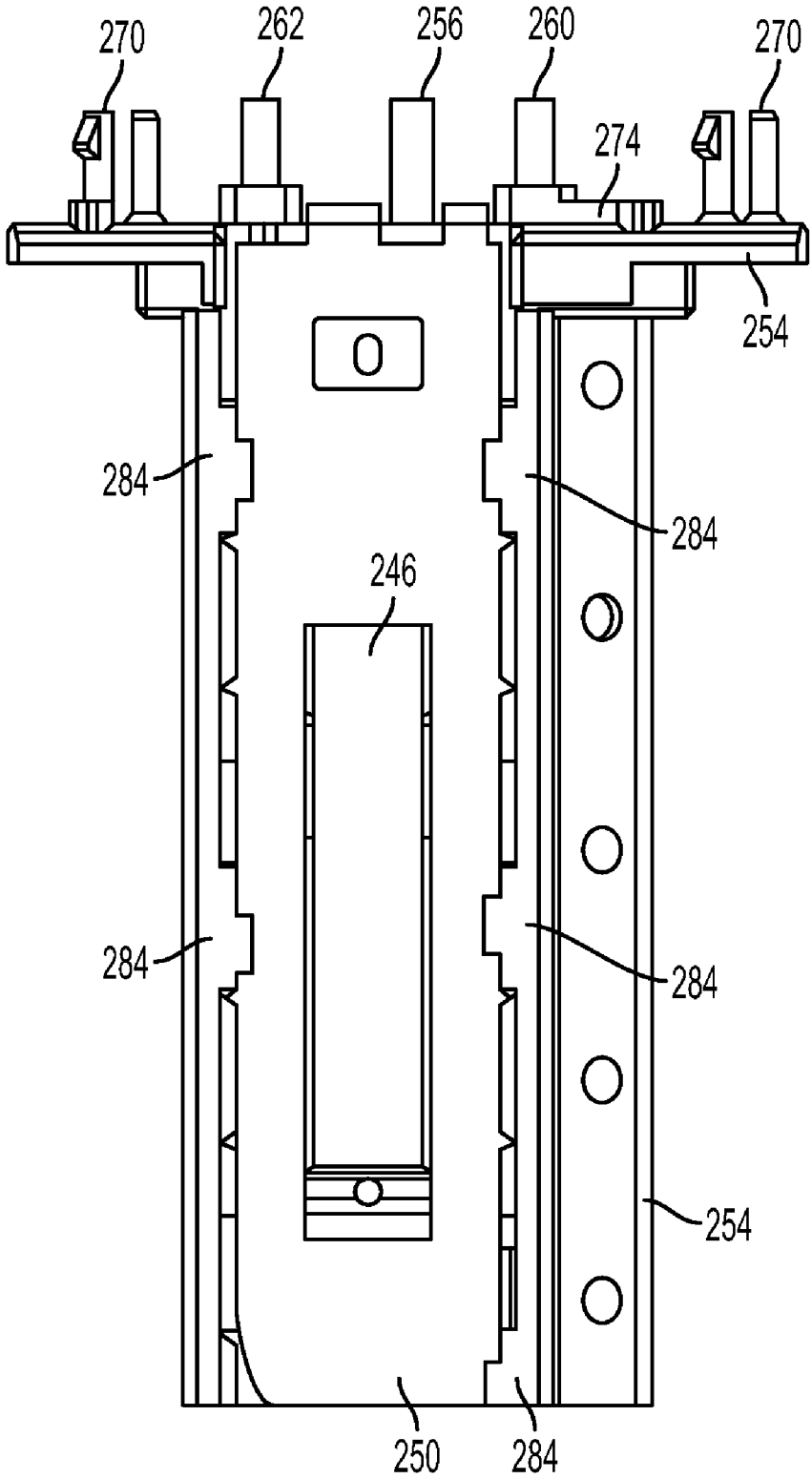
FIG. 13 is a front elevational view of the level sensor of FIG. 12.
Figure 14:
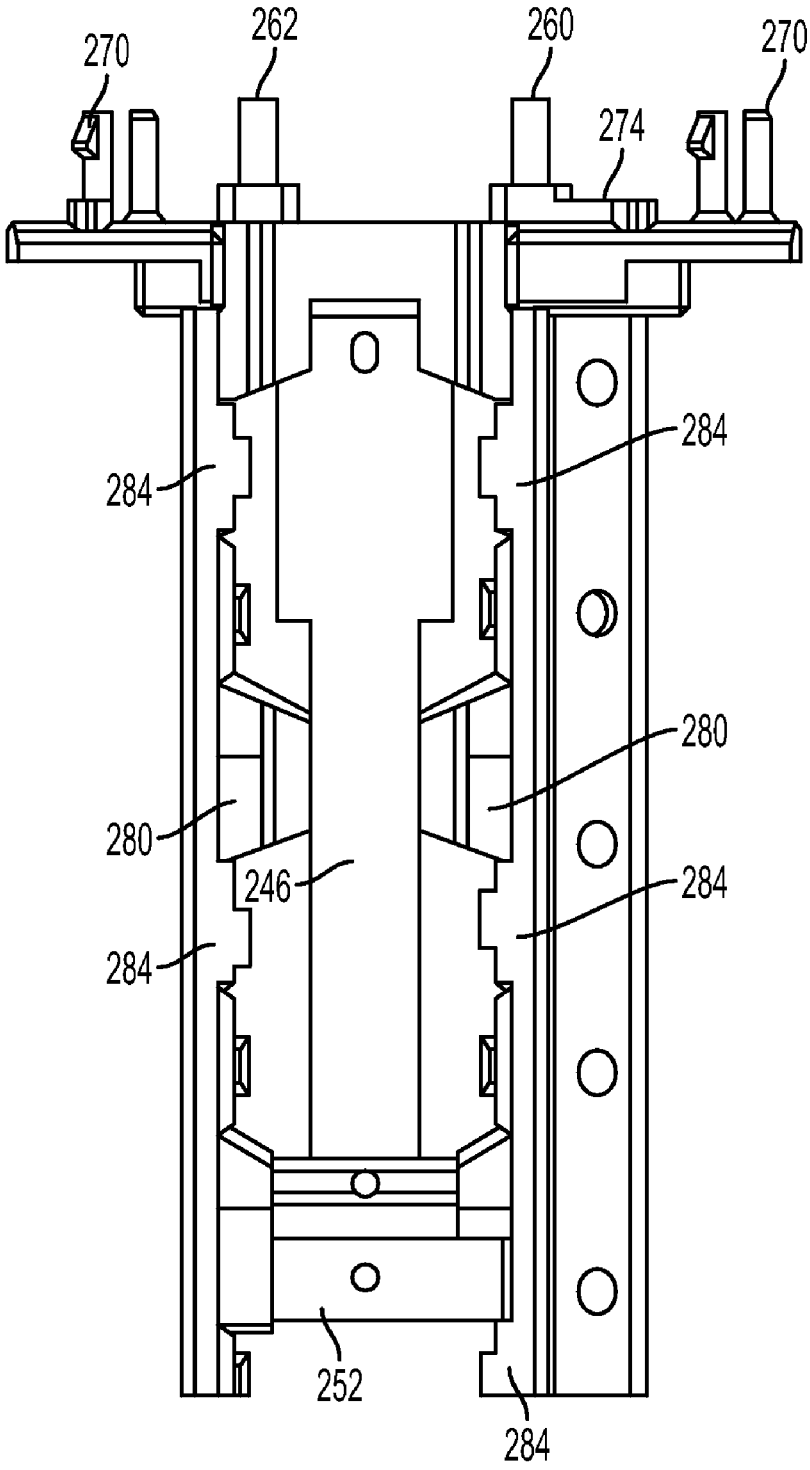
FIG. 14 is a front elevational view of the level sensor of FIG. 12 with the outer probe removed.

The probe support 254 may be formed of any suitable material that is capable of providing the desired electrically isolating properties, such as a plastic material. As shown in FIGS. 12-14, the support frame 254 may include attachment features that facilitate attachment of the level sensors 200 to the sensor supports 208 that connect the sensors to the reservoirs. For example, in the embodiment of FIGS. 12-14, the probe support 254 includes connection studs 270 and standoffs 274 that enable the level sensors to be fixedly or removably secured to the support member and precisely positioned with respect to the support member so that the tabs 260, 262, 256 of the probes may extend through openings in the support members for connection to a signal transmitting/receiving member.

The lower 248 and upper probe 246 of each level sensor 200 may be made integral with the support frame by positioning the lower and upper probes in predetermined positions with respect to each other in a molding tool having the desired final shape of the insulating support frame and over molding the lower and upper probes in the molding tool with a suitable insulating material such as plastic. The support frame may be molded with suitable features that enable the outer probe to be assembled to the molded frame without using adhesive or additional parts. For example, the probe support frame 254 may include standoffs 280 (best seen in FIG. 14) and opposing tabs 284 that define a slot in the direction of insertion that is configured to receive the outer probe 250 and to position the outer probe 250 with respect to the upper 246 and lower probes 248 to provide a predetermined gap therebetween. The standoffs 280 and opposing tabs 284 may be offset as depicted in FIG. 14 to allow for molding in an injection molding machine.

The gap between the outer probe 250 and the upper 246 and lower probes 248 may be any suitable distance that allows the ink to flow freely between the probes while maximizing signal transmission through the ink from the outer probe to the upper and lower probes. A gap that is too small between the outer probe and the upper and lower probes may cause the ink to move sluggishly between the probes, due to surface tension effects. This sluggish movement, especially as the ink drains off the probe, may cause inaccurate level readings, as the ink between the two probes may be of a higher level than the ink in the reservoir. Any suitable means or method, however, may be used to attach the outer probe to the probe support frame to provide the predetermined gap between the outer probe and the upper and lower probes. Molding the support frame around the upper and lower probes enables accurate and repeatable positioning of the probes relative to one another and to the frame.

Figure 15:
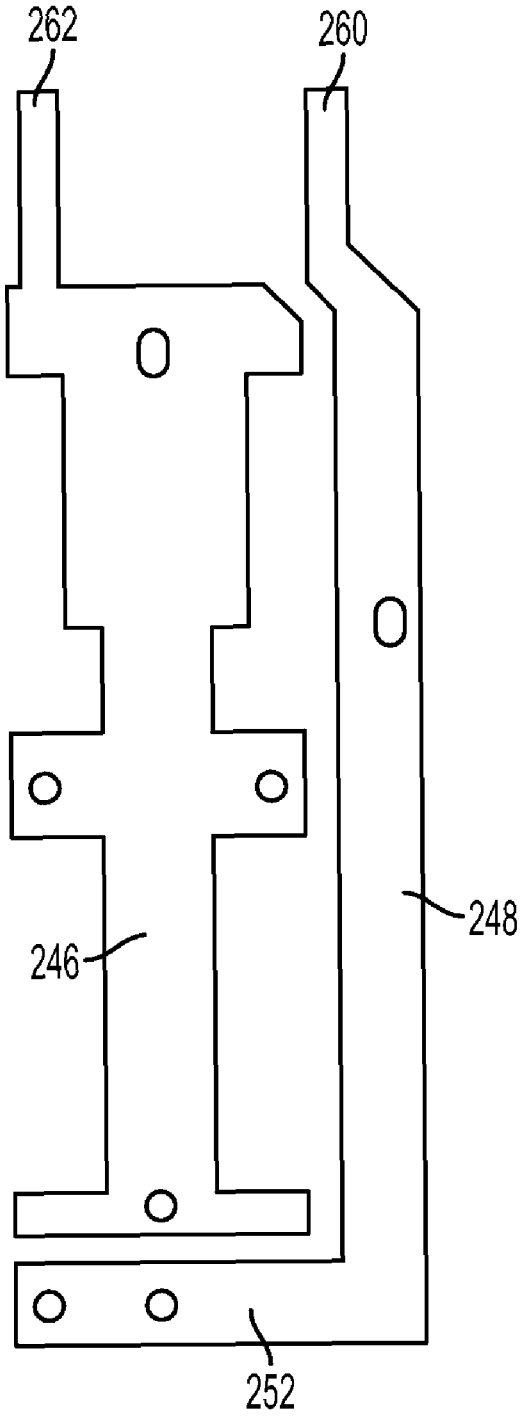
FIG. 15 is a front elevational view of the upper and lower probes of the level sensor of FIG. 12.

FIG. 15 best shows the spatial relationship of the lower probe 248 and upper probe 246 with respect to each other in the support frame (not shown in FIG. 5). As seen in FIG. 15, the lower probe 248 includes a lower portion 252 that is configured to extend to the bottom portion of the level sensor 200 below the upper probe 248 so that the lower portion 252 of the lower probe is positioned at or near the bottom of an ink reservoir when the level sensor is inserted into the reservoir. The upper probe 246 is positioned above the portion 252 of the lower probe 248 and extends to an upper portion of the probe support. As seen in FIGS. 12-14, the outer probe 250 is positioned on the probe support 254 so that it extends substantially from the bottom to the top of the probe support frame 254 alongside both the lower probe 248 and the upper probe 246.

Each of the upper 246, lower 248, and outer probes 250 of each ink level sensor 200 is operably connected to an ink level controller 204. The ink level controller 204 may be implemented in the circuit board 210, or alternatively, may be in communication with the circuit board 210 via a suitable connection device such as a pin connector (not shown). Each of the upper 246, lower 248, and outer probes 250 includes a connection point, or tab, that extends upward through the top portion of the insulating support assembly for connection to the signal transmitting/receiving member. For example, the outer probe includes tab 256, lower probe includes tab 260, and upper probe includes tab 262 that each extends upward through the top portion of the probe support. The tabs of the probes of the level sensors are operably coupled to the circuit board via a suitable signal transmitting/receiving member. The signal transmitting/receiving members may comprise any suitable device or method that enables signal transmission between the probes of the level sensors and the ink level controller.

As depicted in FIGS. 4, 5, and 8-10, the signal transmitting/receiving members 214 comprise flexible circuit members, referred to herein as flex tape, that include probe traces that extend between and electrically connects the circuit board 210 and the respective tabs of the probes of the level sensors. In the embodiment of FIGS. 8-11 in which two level sensors 200 are supported in adjacent reservoirs by a single support member 208, a single flex tape 214 may be utilized to route the input and output signals between the two level sensors 200 and the circuit board 210. The flex tape 214 includes connection points 218 for electrically connecting the probe traces of the flex tape to the appropriate probe tabs. The probe tabs may be connected to the connection points on the flex tape in any suitable manner, such as by soldering. The probe traces include input signal traces 220 that extend between the tabs 256 of the outer probes 250 of the level sensors and the circuit board 210 and output signal traces 224 extending between the tabs 260, 262 of the upper and lower probes of the level sensors and the circuit board 210. The flex tape 214 includes ground traces 228 between the input signal traces and the output signal traces. The ground traces shunt any leakage currents on the flex tape 214 directly to ground such that no leakage current flows from an outer probe trace to an upper or lower probe trace. Although a flex tape with signal traces is shown, other means for transmitting signals to and from the ink level sensors may be utilized including wires, coaxial cables or wireless transmitters and receivers.

To detect the level of ink in an ink reservoir, an AC signal 230 is driven, or input to the tab 256 of the outer probe 250. The ink 290 conducts the AC signal to the lower probe 248 and to the upper probe 246. Controller 204 shown in FIG. 16 detects a current flow from the outer probe 250 through the ink 290 to the lower probe 248. Controller 204 also detects a current flow from the outer probe 250 through the ink 290 to the upper probe 246. Assuming that the ink temperature and conductivity remains relatively consistent, a substantially constant current flow is detected via the lower probe 248. Varying levels of current flow are detected via the upper probe 246 as more or less of the upper probe's surface area is covered or uncovered in ink. The controller 204 is configured to calculate the ratio of the varying current flow in the upper probe 246 to the constant current flow of the lower probe 248 resulting in a continuous measurement of the height of ink in the ink reservoir.

Figure 16:
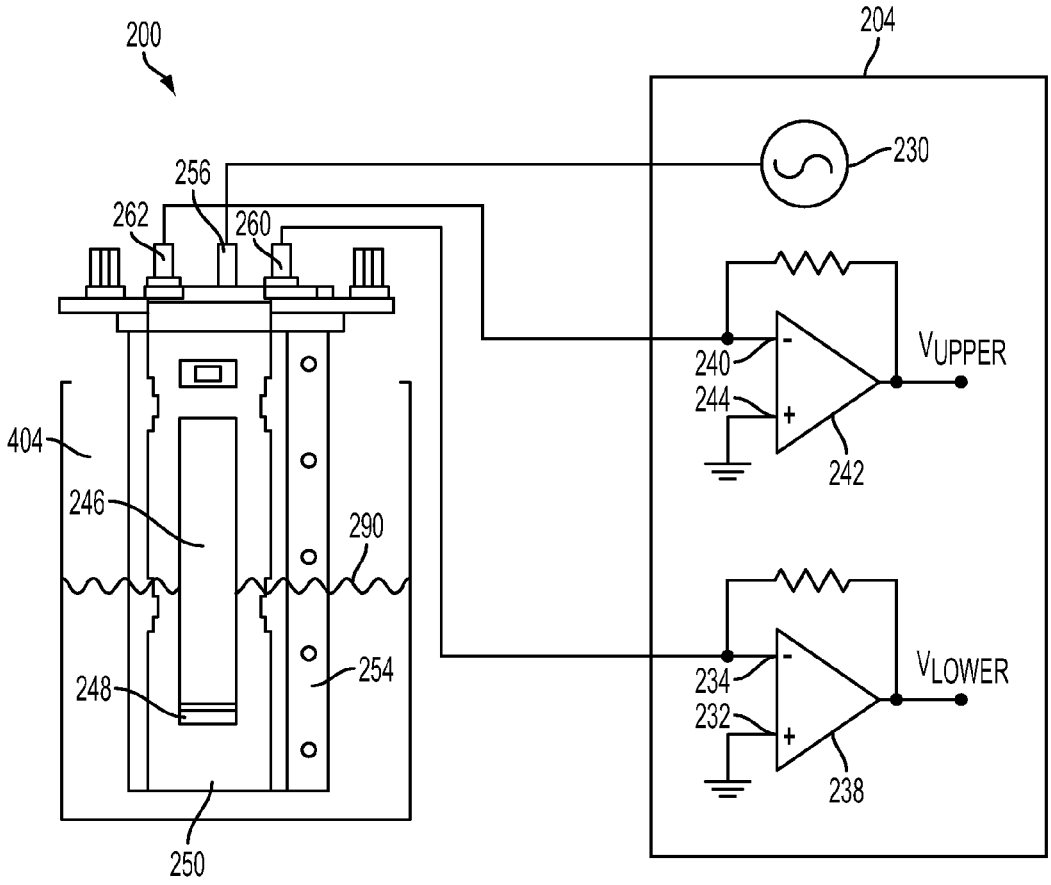
FIG. 16 is a simplified schematic and circuit diagram of an ink level sensor and ink level controller.

As depicted in FIG. 16, the lower probe 248 is electrically connected to the negative input 234 of op/amp 238 in controller 204. This negative input 234 forms a virtual ground by connecting the positive input 232 of op/amp 234 to ground and also connecting the negative input 234 of op/amp 238 through a resistor to the output of op/amp 238. This virtual ground circuit eliminates any stray currents that can arise due to conductivity from the probes and associated traces and wires to electrical ground (i.e., reservoir body and other metal structures). Responsive to the current flow from the outer probe 250 through the ink 290 to lower probe 248, op/amp 238 outputs a voltage $V_{lower}$ that is an expression of a conductance of the ink 290 in the reservoir 404. The conductance is measured for substantially any level of ink 290 in the reservoir 404 because the lower probe 248 is positioned near the bottom of the reservoir 404.

The upper probe 246 is electrically connected to the negative input 240 of op/amp 242 in controller 204. This negative input 240 forms a virtual ground by connecting the positive input 244 of op/amp 242 to ground and also connecting the negative input 240 of op/amp 242 through a resistor to the output of the op/amp 242. This virtual ground circuit eliminates any stray currents that can arise due to conductivity from the probes and associated traces and wires to electrical ground (i.e., reservoir body and other metal structures). Responsive to the current flow from the outer probe 250 through the ink 290 to upper probe 246, op/amp 242 outputs a voltage $V_{upper}$ that is an expression of a conductance of the ink 290 contacting the surface area of the upper probe 246. As the level of the ink 290 varies in reservoir 40, that amount of surface area of upper probe 246 immersed in the ink 290 varies resulting in a varying conductance.

The controller 204 calculates the ratio of the variable $V_{upper}$ to the base value of $V_{lower}$. The ratio calculation can be accomplished by connecting the outputs of the virtually grounding op/amps 242, 238 to analog-to-digital converters (not shown) and dividing the two digital values within controller 204. Any other methods of calculating ratios of voltages commonly known in the art are contemplated to be within the scope of this disclosure. This ratio gives a continuous measurement of the level of ink 290 in reservoir 404. The conductance of ink varies over types of inks and even within the same type of ink at different temperatures. The two probes 246, 248, along with virtually grounding op/amps 242, 238, and controller 204, result in a ratio of two conductivities. Thus, no matter what type of ink or what temperature the ink, within the physical limitations imposed by components such as the resistors, a ratio of conductance is measured which correlates to ink fluid level within the reservoir chamber.

Phase change ink printers including the level sensors above are optimized for use with ink having a particular conductivity or having a conductivity within a nominal range. Phase change inks of different formulations, including color, typically have unique inherent conductivities. Therefore, contaminated ink including ink having a color or formulation not intended for use with a particular reservoir or batches of ink with extreme conductivity may cause the conductivity of the ink volume in one or more of the reservoirs to vary beyond a range that is acceptable to performance when that conductivity is used. As used herein, "contaminated" or "contamination" is used to describe a body of fluid with conductivity outside of a nominal range due to the addition/presence of unintended materials. Due to variation inherent in the manufacture of ink from raw components, a moderate variation in the conductivity of the ink may be expected from batch to batch and accounted for accordingly. If ink having a conductivity that exceeds the range of reliable operation of a level sensor enters the reservoir, the level readings generated by the level sensor for that reservoir may not be accurate or the level sensor may fail altogether resulting in various printhead failures, including introduction of air which causes jetting failure, and weeping of jets which can contaminate the drum.

In response to the difficulties presented by varying ink conductivity levels, a conductivity fault tolerant (CFT) operational mode has been developed that enables the printing operations to be continued in the presence of ink conductivity variations. In the fault tolerant mode, the start fill, stop fill, and last dose levels that are used during normal printing operations, i.e., when the ink conductivity levels are within normal limits, are adjusted to CFT levels. As mentioned above, in the CFT mode, the start fill and last dose levels are adjusted to CFT levels that are selected to prevent or reduce the chances of under and overfilling of the reservoirs that may result from inaccurate level readings. For example, when the detected ink conductivity level of an ink reservoir falls below or exceeds a predetermined range, the start fill level at which an ink melt duty cycle is initiated to supply melted ink to the reservoir is increased by a predetermined amount to a CFT start fill level so that the ink melt duty cycle is initiated at an earlier volume level to reduce the opportunity for an inaccurate level reading to cause the reservoir to be under filled and possibly run out of ink. Similarly, when in the conductivity fault tolerant mode, the stop fill level may be decreased to a CFT stop fill level so that the ink melt duty cycle is terminated at an earlier volume level relative to the normal stop fill volume level to reduce the opportunity for an inaccurate level reading to cause the reservoir to be over filled and possibly spill ink. The last dose level may also be adjusted in a manner similar to the start fill level by increasing the last dose by a predetermined amount so that warnings may be generated at an earlier volume level relative to the normal last dose level to reduce the opportunity for an inaccurate level reading to cause the reservoir to inadvertently run out of ink.

The adjusted CFT start fill, stop fill, and last dose levels of the fault tolerant mode may be any suitable ink levels selected to prevent or limit the ability of the ink reservoir to under fill, over fill, or run dry as a result of variations in ink level readings that may be caused by variations in ink conductivity. The adjusted start fill, stop fill, and last dose levels may be determined, for example, during manufacturer and testing of the imaging device, and programmed into the system memory for access by the ink level controller.

The controller is configured to continue monitoring the ink conductivity levels of ink reservoirs operating in the conductivity fault tolerant mode until the ink conductivity level indicates that the ink conductivity has returned to the normal operational conductivity range. Once the ink conductivity has returned to the normal operating range, the CFT mode may be terminated and the start fill, stop fill, and last dose levels may be set to the normal operating levels. In some embodiments, the controller may be configured to maintain the reservoir in the CFT mode for a predetermined number of melt cycles after the ink conductivity levels have returned to normal. For example, the controller may be configured to return the start fill, stop fill, and last dose levels to the normal operating levels after the ink conductivity has remained within normal limits for 10 melt cycles, although any suitable number of cycles may be used.

If the ink conductivity level of an ink reservoir in the conductivity fault tolerant mode does not return to the normal operational range within a certain predefined limit, the controller may be configured to declare a service fault in which printing operations may be disabled and/or a user recognizable warning is generated. For example, in one embodiment, the ink level controller may be configured to count the number of melt duty cycles that are performed for an ink reservoir in the conductivity fault tolerant mode and if a predetermined number melt duty cycles is reached, a service fault is declared. In one embodiment, the controller is configured to declare a service fault after ten melt duty cycles have been performed for a contaminated reservoir without the ink conductivity levels of the contaminated reservoir returning to normal although the service fault may be declared after any suitable number of melt duty cycles have been performed.

In one embodiment, the conductivity fault tolerant mode is implemented as a software controlled algorithm in the controller. The control software is configured to recognize a contamination event by monitoring a nominal ink conductivity sensor positioned in each melt reservoir in the imaging device. As mentioned above, the lower probe of the level sensor assemblies described above may be used to detect the ink conductivity of the ink volume in the melt reservoirs. Accordingly, in one embodiment, the nominal ink conductivity sensor for a melt reservoir corresponds to the lower probe of the level sense probe assembly for the reservoir. The control software is configured to compare the ink conductivity levels indicated by the nominal ink conductivity sensors for the melt reservoirs to a nominal operational value or value range for the level sensors of the melt reservoirs. The comparison of the ink conductivity level of a melt reservoir may be performed at any suitable frequency. In one embodiment, the control software is configured to compare the ink conductivity level of the ink volume in a melt reservoir to the nominal operational value or value range at a frequency of approximately 2.5 Hz although any suitable frequency may be used.

The control software recognizes a contamination event if the monitored ink conductivity of an ink volume in a melt reservoir exceeds or falls below the nominal operational value or value range. The control software may also be configured to compare the monitored ink conductivities of ink volumes in the melt reservoirs to minimum and maximum threshold values. Detected ink conductivity levels that fall below the minimum or exceed the maximum threshold values may be indicative of a fault condition that may not be correctable by flushing the ink from the reservoirs and that may require maintenance that goes beyond the capabilities of the maintenance system of the imaging device. If the control software determines that the ink conductivity level of a melt reservoir falls below the minimum or exceeds the maximum threshold value, the control software may be configured to disable print operations and alert a user that a fault has occurred and that a service call may be required.

The control software may also be configured to recognize a contamination event in response to the rate of change of the ink conductivity of the ink volume in a melt reservoir exceeding a predetermined operational rate of change. For example, the controller may be configured to determine a rate of change of the ink conductivity for the ink volume in a melt reservoir by comparing current ink conductivity readings of an ink volume in a melt reservoir to previous ink conductivity readings for the ink volume. The control software may then be configured to compare the determined rate of ink conductivity change for a melt reservoir to a predetermined rate or rate range of ink conductivity change. The control software may be configured to recognize a contamination event if the monitored ink conductivity change rate of a melt reservoir exceeds or falls below the predetermined rate or rate range.

Figure 17:
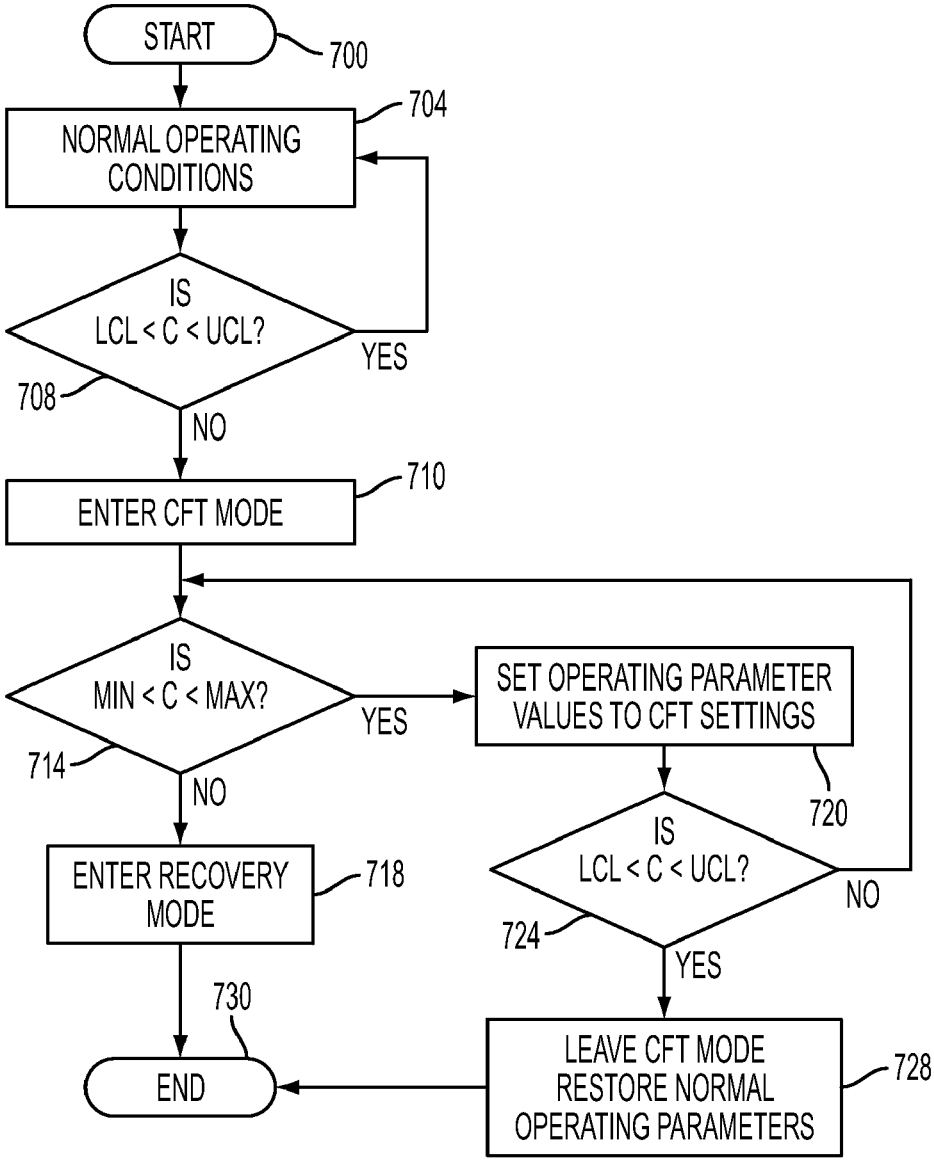
FIG. 17 is a flow chart showing an algorithm for a conductive fault tolerant operational mode for use with the imaging device of FIG. 1.

Referring now to FIG. 17, there is shown a flow chart of a software controlled algorithm for implementing the conductivity fault tolerant (CFT) mode described above. As mentioned, the control software is configured to monitor the ink conductivities of the ink volumes in the melt reservoirs indicated by the ink conductivity sensors for the melt reservoirs. According to the flow chart, the ink conductivity of the ink volume in a reservoir is compared to an upper conductivity operational limit (UCL) and a lower conductivity operational limit (LCL) to determine if the ink conductivity is within the operational limits of the level sensor in the melt reservoir (block 708). If the ink conductivity is within the operational range defined by the upper and lower limits, control returns to block 704 and normal printing operations are continued. If the detected ink conductivity is not within the operational range defined by the upper and lower limits, the CFT mode is entered (block 710). Control then passes to block 714 at which the ink conductivity is compared to a minimum and a maximum threshold value. If the ink conductivity falls below the minimum threshold value or exceeds the maximum threshold value, control passes to block 718 at which a recovery mode is entered and the algorithm ends (block 730). If the detected ink conductivity is between the minimum and maximum threshold values, then the start fill, stop fill, and last dose levels are set to the CFT start fill, stop fill, and last dose levels (block 720).

The control software is configured to continue monitoring the ink conductivity level of the ink volume in ink reservoirs in the CFT mode until the conductivity levels return to the normal operating range (block 724) at which point the CFT mode may be terminated and the start fill, stop fill, and last dose levels are returned to the levels used during normal printing operations (block 728). In one embodiment, the controller may be configured to remain in the CFT mode until a predetermined number of melt cycles have been performed with the ink conductivity remaining within normal operating limits at which point the CFT mode may be terminated and the start fill, stop fill, and last dose levels are returned to the levels used during normal printing operations.

Those skilled in the art will recognize that numerous modifications can be made to the specific implementations of the ink conductivity recovery methods described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating an imaging device, the method comprising:

measuring an ink conductivity of an ink volume in an ink reservoir of an imaging device;

operating the imaging device in a conductive fault tolerant mode in response to the measured ink conductivity being outside of a predetermined ink conductivity operational range, in the conductive fault tolerant mode at least one parameter of a melt duty cycle for the ink reservoir is set to a corresponding conductive fault tolerant (CFT) level.

2. The method of claim 1, wherein the at least one parameter of the melt duty cycle comprises at least one of a start fill, a stop fill, and a last dose level for use with the ink reservoir.

3. The method of claim 2, the operation of the imaging device in the conductive fault tolerant mode further comprising:

setting the start fill level to a CFT start fill level, the CFT start fill level being greater than a default start fill level used in a normal operating mode of the imaging device;

setting the stop fill level to a CFT stop fill level, the CFT stop fill level being less than a default stop fill level used in the normal operating mode; and setting the last dose level to a CFT last dose level, the CFT last dose level being greater than a default last dose level used in the normal operating mode.

4. The method of claim 3, further comprising:

measuring the conductivity of the ink in the ink reservoir when in the CFT mode;

setting the start fill, the stop fill, and the last dose level of the ink reservoir to the default start fill, the default stop fill, and the default last dose levels in response to the ink conductivity in the ink reservoir returning to a the predetermined ink conductivity operational range.

5. The method of claim 4, the setting of the start fill, the stop fill, and the last dose levels further comprising:

counting melt cycles performed after measured ink conductivity returns to the predetermined ink conductivity operational range; and setting the start fill, the stop fill, and the last dose level of the ink reservoir to the default start fill, the default stop fill, and the default last dose levels, respectively, in response to the ink conductivity remaining within the predetermined ink conductivity operational range for a predetermined number of melt cycles.

6. The method of claim 2, further comprising:

prior to setting the at least one parameter of the melt duty cycle, comparing the detected ink conductivity to a minimum and a maximum threshold value;

in response to the detected ink conductivity falling below the minimum threshold value or exceeding the maximum threshold value, generating a user recognizable alert.

7. The method of claim 1, the detection of the ink conductivity further comprising:

measuring the conductivity of the ink in the ink reservoir with a lower probe of an ink level sensor in the ink reservoir.

8. The method of claim 1, the detection of the ink conductivity and the comparison of the ink conductivity being performed at a predetermined frequency.

9. The method of claim 1, the predetermined frequency comprising 2.5 Hz.

10. The method of claim 1, the measuring of the ink conductivity further comprising:

measuring an ink conductivity of an ink volume in a plurality of ink reservoirs of an imaging device, each ink reservoir in the plurality being configured to receive a different ink from the ink supply and to deliver the received ink to at least one printhead of the imaging device.

11. The method of claim 10, the comparison of the detected ink conductivity further comprising:

comparing the measured ink conductivity for each of the ink reservoirs to a predetermined ink conductivity operational range for each ink reservoir.

12. A system for use with an imaging device, the system comprising:

an ink conductivity sensor positioned in an ink reservoir of an imaging device, the ink conductivity sensor being configured to generate a signal indicative of an ink conductivity of a volume of ink in the ink reservoir;

a controller configured to receive the signal from the ink conductivity sensor and to compare the ink conductivity indicated by the signal to a predetermined ink conductivity operational range, the controller being configured to enter a conductivity fault tolerant mode in response to the ink conductivity being outside of the predetermined ink conductivity operational range in which at least one parameter of a melt duty cycle for the ink reservoir is set to a corresponding conductive fault tolerant (CFT) level.

13. The system of claim 12, the at least one parameter comprising at least one of a start fill, a stop fill, and a last dose level.

14. The system of claim 13, the controller being configured to set the start fill, the stop fill, and the last dose level to a corresponding CFT start fill, CFT stop fill, and CFT last dose level, the CFT start fill level being greater than a default start fill level used in a normal operating mode of the imaging device, the CFT stop fill level being less than a default stop fill level used in the normal operating mode, and the CFT last dose level being greater than a default last dose level used in the normal operating mode.

15. The system of claim 14, the controller being configured to measure the conductivity of ink in the ink reservoir when in the CFT mode, and to set the start fill, the stop fill, and the last dose level of the ink reservoir to the default start fill, the default stop fill, and the default last dose levels, respectively in response to the ink conductivity in the ink reservoir returning to the predetermined ink conductivity operational range.

16. The system of claim 15, further comprising:

a user recognizable alert generator, the controller being configured to compare the measured ink conductivity to a minimum and a maximum threshold value when entering the CFT mode and to actuate the user recognizable alert generator to generate a user recognizable alert in response to the measured ink conductivity falling below the minimum threshold value or exceeding the maximum threshold value.

17. The system of claim 16, the ink conductivity sensor further comprising:

a separate ink conductivity sensor positioned in each ink reservoir in a plurality of ink reservoirs of the imaging device, each ink reservoir being configured to hold a different ink.

18. The system of claim 17, the controller being configured to compare the ink conductivity of a respective ink reservoir to a predetermined ink conductivity operational range for the respective ink reservoir, the controller being configured to enter the CFT mode in response to the ink conductivity of one of the ink reservoirs being outside of the predetermined ink conductivity operational range for the ink reservoir.

19. The system of claim 18, further comprising:

a memory for storing the predetermined ink conductivity operational range for each of the ink reservoirs.

* * * * *